United States Patent [19]

Matsuda et al.

[11] 4,400,456

[45] Aug. 23, 1983

[54] THERMO-DEVELOPABLE TYPE DIAZO COPYING MATERIAL

[75] Inventors: Tsutomu Matsuda, Shizuoka; Shigeru Kusakata, Susono, both of Japan

[73] Assignee: Ricoh Co., Ltd., Tokyo, Japan

[21] Appl. No.: 295,036

[22] Filed: Aug. 21, 1981

[30] Foreign Application Priority Data

Aug. 29, 1980 [JP] Japan ..... 55-118279

[51] Int. Cl.[3] ..... G03C 1/60; G03C 1/58

[52] U.S. Cl. ..... 430/138; 430/151; 430/158; 430/159; 430/160; 430/176; 430/179

[58] Field of Search ..... 430/151, 179, 138, 158, 430/160, 162, 176

[56] References Cited

U.S. PATENT DOCUMENTS

| | | | |
|---|---|---|---|
| 3,202,510 | 8/1965 | Hollmann | 430/138 |
| 3,322,556 | 5/1967 | Munder et al. | 430/138 |
| 3,469,981 | 9/1969 | Kosar | 430/151 |
| 3,493,374 | 2/1970 | Roncken et al. | 430/176 |
| 3,615,537 | 10/1971 | Jacobus et al. | 430/151 |
| 3,642,483 | 2/1972 | Kubo et al. | 430/151 |

*Primary Examiner*—Charles L. Bowers, Jr.

*Attorney, Agent, or Firm*—Flynn, Thiel, Boutell & Tanis

[57] ABSTRACT

A thermo-developable type diazo copying material is disclosed comprising a substrate and a photosensitive layer, formed thereon, consisting essentially of a diazo compound, a coupler and a color assistant, wherein said color assistant is at least a member selected from the group consisting of fatty acid amides having the general formula I:

$$R^1CONH_2$$

(wherein, $R^1$ is a saturated or unsaturated aliphatic hydrocarbon group having 5 to 24 carbon atoms), N-substituted fatty acid amides having the general formula II:

$$R^1CONHR^2$$

(wherein, $R^1$ is the same as defined above and $R^2$ is an alkyl group having 1 to 5 carbon atoms, substituted or non-substituted phenyl group or substituted or non-substituted cyclohexyl group) and N-substituted fatty acid amides having the general formula III:

$$R^1NHCOR^2$$

(wherein, $R^1$ and $R^2$ are the same as defined above respectively), and said coupler is encapsulated with a member selected from the group consisting of non-polar wax-like substances having a melting point of 50° to 150° C. and hydrophobic vinyl resins having a softening point of 50° to 150° C.

7 Claims, No Drawings

THERMO-DEVELOPABLE TYPE DIAZO COPYING MATERIAL

BACKGROUND OF THE INVENTION (a) Field of the Invention

The present invention relates to a thermo-developable type diazo copying material which is also usable as a recording material.

(b) Description of the Prior Art

Thermo-developable type diazo copying materials are generally comprised of a substrate such as paper, film or the like and a photosensitive layer, formed thereon, which consists essentially of a diazo compound, a coupler and a color assistant. As the color assistant there is employed urea, sodium trichloroacetate or the like. The diazo copying materials of this type are each developed by heating at a high temperature of 150° to 200° C. The developing mechanism is designed to utilize alkali (ammonia gas or caustic soda) generated by heat decomposition. In order to achieve development at a low temperature such as 90° to 130° C., an attempt has been made to use higher fatty acid amides as the color assistant, and the developing mechanism used therefor is designed to utilize the phenomenon that the diazo compound and coupler are melted by heating and thus are activated.

In the conventional thermo-developable type diazo copying materials, however, the former copying materials are defective in that since development is effected at a high temperature as aforesaid, it is necessary to selectively employ a highly heat-resistant diazo compound. This is unfavorable for the formation of a high density image, because with diazo copying materials of this type, generally speaking, it is difficult to obtain a high density image as compared with dry diazo copying materials which are developed with ammonia gas. Further, a heating device adapted to maintain a high accuracy even at high temperatures is required, because if the temperature is not controlled within the limits of about ±10° C., there will be caused insufficient development and changes in color tone. The copying machine unavoidably becomes expensive when such devices are used. The copying materials in the latter case, on the other hand, are defective in that development can be carried out at low temperatures but the preservability of the copying material itself (which will be called "raw preservability" hereinafter) deteriorates with time.

U.S. Pat. No. 3,202,510 discloses a thermo-developable type diazo copying material in which an alkali generating agent such as urea is employed as a color assistant so that color may be formed only when the material is heated and a coupler is encapsulated with a wax-like substance such as microcrystalline wax. However, this copying material has poor color formability.

Methods using thermo-developable type diazo copying materials are surely advantageous in that dry copies can be obtained, and the copying machines used therefor can be made compact due to the simplicity of the developing sections but they cannot become the leading diazo copying processes due to the aforesaid defects.

SUMMARY OF THE INVENTION

It is an object of the present invention to provide a thermo-developable type diazo material which can serve two purposes of copying and recording, which permits the production of high density images by developing at a low temperature of about 90° to 130° C., is superior in raw preservability notwithstanding the use of an inexpensive copying machine, and can be produced cheaply.

In particular, the present invention intends to provide a thermo-developable type diazo copying material comprising a substrate and a photosensitive layer formed thereon, consisting essentially of a diazo compound, a coupler and a color assistant, wherein said color assistant is at least one member selected from the group consisting of fatty acid amides having the general formula I:

$$R^1CONH_2$$

(wherein $R^1$ is a saturated or unsaturated aliphatic hydrocarbon group having 5 to 24 carbon atoms), N-substituted fatty acid amides having the general formula II:

$$R^1CONHR^2$$

(wherein $R^1$ is the same as defined above and $R^2$ is an alkyl group having 1 to 5 carbon atoms, substituted or non-substituted phenyl group or substituted or non-substituted cyclohexyl group) and N-substituted fatty acid amides having the general formula III:

$$R^1NHCOR^2$$

(wherein $R^1$ and $R^2$ are the same as defined above respectively), and said coupler is encapsulated with a member selected from the group consisting of non-polar wax-like substances having a melting point of 50° to 150° C. and hydrophobic vinyl resins having a softening point of 50° to 150° C.

According to the present invention, low temperature development can be achieved by the use of fatty acid amides as the color assistant, and lowering of the raw preservability which can be caused by said low temperature development can be prevented by encapsulating the coupler with the selected non-polar wax-like substance or hydrophobic vinyl resin. In addition, the present invention is advantageous in that the low temperature development makes it possible to employ a diazo compound favorable for the formation of high density images.

DETAILED DESCRIPTION OF THE INVENTION

Of the color assistants suitably used in the present invention, concrete examples of fatty acid amides having the general formula I include caproic acid amide, caprylic acid amide, capric acid amide, lauric acid amide, myristic acid amide, palmitic acid amide, stearic acid amide, arachidic acid amide, behenic acid amide, palmitoleic acid amide, oleic acid amide, eicosenoic acid amide, erucic amide, elaidic amide, trans-1,1-eicosenoic acid amide, linolic acid amide, linolenic acid amide, ricinoleic acid amide and the like. Of N-substituted fatty acid amides having the general formulas II and III, concrete examples of N-substituted fatty acid amides having the general formula II include N-methylpalmitic acid amide, N-methylstearic acid amide, N-propylstearic acid amide, N-butylstearic acid amide, stearic acid anilide, N-methylbehenic acid amide,N-ethylbehenic acid amide, N-butylbehenic acid amide, behenic acid anilide, N-methyloleic acid amide, linolic acid anilide, N-ethylcapric acid amide, N-butyllauric acid amide, capric acid-o-methoxyanilide, N-hexylstearic acid amide and the like, and concrete examples of N-substituted fatty acid amides having the general formula III include N-octadecylacetamide, N-octadecylbutylamide, N-octadecylpropionamide, N-oleylacetamide, N-oleylbenzamide, N-laurylbutylamide, N-laurylbenzamide, N-behenylacetamide, N-behenylpropionamide, N-behenylbenzamide, N-myristylbenzamide, N-stearylbenzamide, N-stearylacetamide, N-stearylcyclohexylamide, N-stearyl-o-chlorobenzamide, N-palmitylbenzamide, N-palmitylacetamide and the like. The above-enumerated fatty acid amides and N-substituted fatty acid amides are all solid and water insoluble at room temperature. The particle diameter thereof is preferably 1 to 50$\mu$. At any rate, if $R^1$ has less than 5 carbon atoms in the general formulas I to III the preservability deteriorates, while if $R^1$ has more than 24 carbon atoms in the general formulas I to III the low temperature development cannot be carried out.

According to the present invention, the coupler is encapsulated with the aforesaid wax-like substance or vinyl resin, said encapsulation being effected by a known encapsulation method as disclosed for instance in each of U.S. Pat. Nos. 2,800,457 and 2,800,458 using the coupler as the core substance and the hydrophobic vinyl resin or non-polar wax-like substance as the wall substance.

The diameter of the thus encapsulated coupler is preferred to be 1 to 50$\mu$. The hydrophobic vinyl resins used herein have a softening point of 50° to 150° C., preferably 80° to 120° C. As these resins there can be enumerated for instance vinyl acetate-methyl methacrylate copolymer, vinyl acetate-butyl methacrylate-styrene copolymer, vinyl acetate-lauryl methacrylate copolymer, butadiene-styrene-methyl methacrylate copolymer, vinyl acetate-styrene-hydroxyethyl methacrylate copolymer, methyl methacrylate-styrene copolymer, polyvinyl chloride, vinylidene chloridemethyl methacrylate copolymer, vinyl acetate-vinyl chloride copolymer, vinyl acetate-styrene copolymer, polystyrene, polyvinylidene chloride and the like. As a matter of course, however, the hydrophobic vinyl resins used suitably in the present invention are not limited to the ones mentioned.

As the non-polar wax-like substances there can be enumerated those having a melting point of 50° to 150° C., preferably 60° to 90° C., for instance such as paraffin wax, polyethylene wax, polypropylene wax, chlorinated paraffin and the like.

In the present invention, the suitable ratio of the coupler to the vinyl resin or non-polar wax-like substance, in the capsule is 1:(0.5 to 10) (by weight).

Any diazo compound generally used in two component-type diazo copying materials can be used in the present invention. Among them, however, the following diazo compounds having the following general formulas IV and V are preferably used because they are suitable for the formation of high density images:

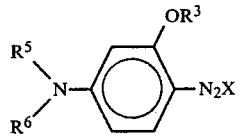

IV (wherein $R^3$ and $R^4$ are each an alkyl group having 1 to 5 carbon atoms, $R^5$ and $R^6$ are each a substituted or non-substituted alkyl, oxyalkyl, aralkyl or cycloalkyl group, or $R^5$ and $R^6$ may form a heterocyclic ring together with the nitrogen atom to which they are bonded, and X represents an anion),

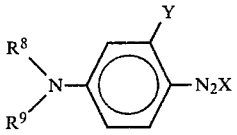

V (wherein $R^7$ is an alkyl group having 1 to 5 carbon atoms, an alkyl group having oxygen atoms or a carbonyl group in the main chain, or a substituted or non-substituted phenyl group, $R^8$ and $R^9$ are each a substituted or non-substituted alkyl group, an alkyl group having oxygen atoms or a carbonyl group in the main chain, an oxyalkyl group, an aralkyl group or a cycloalkyl group, or $R^8$ and $R^9$ may form a heterocyclic rings together with the nitrogen atom to which they are bonded, Y is halogen and X is an anion.)

In this instance, the diazo compound having the general formula IV includes a double salt consisting of a metal halide such as zinc chloride, cadmium chloride, tin chloride or the like and a chloride; a sulfate; or a salt of a fluorine-containing acid such as tetrafluoroborate, hexafluorophosphoric acid or the like, respectively of a compound such as 4-diazo-2,5-dimethoxyphenylmorpholine, 4-diazo-2,5-diethoxyphenylmorpholine, 4-diazo-2,5-dipropoxyphenylmorpholine, 4-diazo-2,5-dibutoxypheylmorpholine, 4-diazo-2,5-dibutoxy-N-benzyl-N-ethylaniline, 4-diazo-2,5-dibutoxy-N,N-dibutylaniline, 4-diazo-2,5-dibutoxy-N-benzyl-N-oxyethylaniline, 4-diazo-2,5-dibutoxyphenylpiperazine, 4-diazo-2,5-diethoxyphenylpyrrolidine, 4-diazo-2,5-dipropoxyphenylpiperidine, 4-diazo-2,5-diethoxyphenyl-N,N-dimethylaniline, or the like. The diazo compound having the general formula V includes a double salt consisting of a metal halide such as zinc chloride, cadmium chloride, tin chloride or the like and a chloride; a sulfate; or a salt of a fluorine-containing acid such as tetrafluoroborate, hexafluorophosphoric acid or the like, respectively of a compound such as 4-diazo-2-butoxy-5-chloro-dimethylaniline, 4-diazo-2-phenoxy-5-chloro-dimethylaniline, 4-diazo-2-(4'-chlorophenoxy)-5-chlorodimethylaniline, 4-diazo-2-butoxy-5-chloro-N,N-benzylaniline, 4-diazo-2-butoxy-5-chloro-N-methyl-N-benzylaniline, 4-diazo-2-(4'-chlorophenoxy)-5-chlorophenylmorpholine, 4-diazo-2-methoxy-5-chlorophenylpiperazine, 4-diazo-2-butoxy-5-chlorophenyl pyrrolidine, 4-diazo-2-ethoxy-5-chloro-N-methyl-N-benzylaniline, 4-diazo-2-phenoxy-5-chlorophenylmorpholine, 4-diazo-2-ethoxy-5-bromodimethylaniline, 4-diazo-2-(4'-chlorophenoxy)-5-fluorodimethylaniline, 4-diazo-2-(4'-chlorophenoxy)-5-N-hydroxyethyl-N-ethylaniline, 4-diazo-2-butoxy-5-chloro-N-cyclohexyl-N-methylaniline, 4-diazo-2-methoxy-5-chloro-N,N-dibenzylaniline, 4-diazo-2-methoxy-5-chloro-N,N-dibenzylaniline,

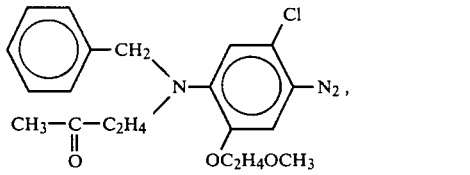

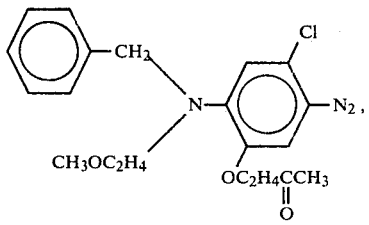

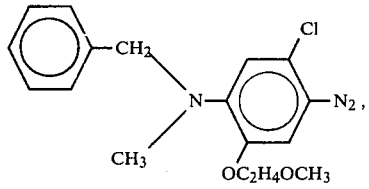

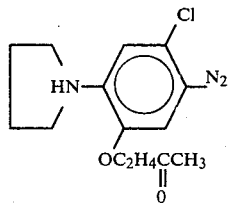

or the like.

Other diazo compounds used in the present invention include a double salt consistng of a metal halide such as zinc chloride, cadmium chloride, tin chloride or the like and a chloride; a sulfate; or a salt of a fluorine-containing acid such as tetrafluoroborate, hexafluorophosphoric acid or the like, respectively of a compound such as 4-diazo-1-dimethylaminobenzene, 4-diazo-1-diethylaminobenzene, 4-diazo-1-dipropylaminobenzene,4-diazo-1-methylbenzylaminobenzene, 4-diazo-1-dibenzylaminobenzene, 4-diazo-1-ethylhydroxyethylaminobenzene, 4-diazo-1-diethylamino-3-methoxybenzene, 4-diazo-1-dimethylamino-2-methylbenzene, 4-diazo-1-benzoylamino-2,5-diethoxybenzene, 4-diazo-1-morpholinobenzene, 4-diazo-1-anilinobenzene, 4-diazo-1-dimethylamino-3-carboxybenzene, 4-diazo-1-toluylmercapto-2,5-diethoxybenzene, 4-diazo-1-(4-methoxyphenylmercapto)-2,5-diethoxybenzene, 4-diazo-1,4-methoxybenzoylamino-2,5-diethoxybenzene or the like.

As the coupler, there can be employed any one that can be used in conventional two-component type diazo copying materials, for instance, such as resorcinol, phloroglucinol, 2,5-dimethyl-4-morpholinomethylphenol, 3-hydroxycyanoacetanilide, parasulfoacetanilide, 1-benzoylamino-8-hydroxynaphthalene-3,6-disulfonamide, 2,2-dihydroxynaphthalene, 2,7-dihydroxynaphthalene-3,6-disulfonate, sodium 2,3-dihydroxy-6-sulfonate, sodium 2,5-dihydroxynaphthalene-6-sulfonate, sodium 1-hydroxynaphthalene-4-sulfonate, 1-amino-3-hydroxynaphthalene-3,6-disulfonamide, Naphthol AS, Naphthol AS-D, 2-hydroxynaphthalene-3-biguanide, 2-hydroxynaphthoic acid morpholinopropyl amide, 2-hydroxynaphoic acid ethanol amide, 2-hydroxynaphthoic acid-N-dimethylaminopropylamide hydrochloride, 2,4,2',4'-tetrahydroxydiphenyl sulfoxide or the like.

The present invention permits the concurrent use of various additives usable in conventional diazo copying materials in addition to the above-mentioned components. In particular, the present invention can use preservability improves such as sodium naphthalenemonosulfonate, sodium naphthalenedisulfonate, sodium naphthalenetrisulfonate, sulfosalicylic acid, cadmium sulfate, magnesium sulfate, cadmium chloride, zinc chloride and the like. Further, the present invention can use thiourea, urea and the like as antioxidants; caffeine, theophyline and the like as solubilizers; citric acid, tartaric acid, sulfuric acid, oxalic acid, boric acid, phosphoric acid, pyrophosphoric acid and the like as acid stabilizers; and additionally can contain saponin in a small amount. Still further, the present invention can use high molecular weight substances such as starch, casein, poly(vinyl acetate), polyacrylic derivatives and the like as binders, and additionally can use inorganic or organic fine particles of silica, starch, clay, resin and the like as image density improvers.

The diazo copying material according to the present invention may be prepared through the steps of forming an aqueous mixture having dissolved or dispersed therein the diazo compound, encapsulated coupler, color assistant and other additives, coating, in a usual manner, a substrate such as paper, film or the like with said aqueous solution and drying to form thereon a photosensitive layer having an adhesion amount of 2.5 to 15 g/m$^2$. Alternatively, the diazo copying material according to the present invention may be prepared as a layered material through the steps of forming an aqueous mixture having dissolved or dispersed therein the encapsulated coupler, color assistant and some of the additives (especially, the image density improver and binder), coating a substrate with said aqueous solution and drying to form a pre-coat layer having an adhesion amount of 2 to 10 g/m$^2$, then making an aqueous mixture having dissolved or dispersed therein the diazo compound and the remainder of the additives, coating the pre-coat layer with said aqueous solution and drying to form a photosensitive layer having an adhesion amount of 0.5 to 5 g/m$^2$. In either instance, the ratio of the diazo compound to the coupler (on the basis of non-encapsulated coupler) to the color assistant preferably is 1:(0.1 to 10):(0.1 to 20) by weight.

There are two methods of forming an image on the thermo-developable type diazo copying material according to the present invention. The first comprises subjecting this thermo-developable type diazo copying material to imagewise exposure using a fluorescent lamp or a mercury lamp and thereafter heating it using infrared rays, a heat roller, high-frequency or the like to a temperature of about 90° to 130° C. as done for conventional diazo copying materials. The other method comprises heating said thermo-developable type diazo copying material imagewise to the above-mentioned temperature by means of a heat pen, a heat head or the like as done for conventional heat-sensitive recording materials. In either method, this thermo-developable type diazo copying material may thereafter be exposed overall to light radiation from a fluorescent lamp or a mercury lamp for the purpose of decomposing the diazo compound remaining unreacted in the non-image area and thereby fixing the image as done for conventional diazo copying materials.

DESCRIPTION OF THE PREFERRED EMBODIMENTS

EXAMPLE 1

10 g of paraffin having a melting point of 68° to 70° C. were dissolved in 100 cc of cyclohexane, and thereafter 10 g of Naphthol AS were dispersed well in the resulting solution. This solution was stirred vigorously in 200 cc of 10% aqueous polyvinyl alcohol solution and emulsified. This emulsified solution was further distilled while stirring vigorously under a reduced pressure condition to thereby remove the cyclohexane therefrom. In this case, the heating temperature was maintained at 50° C. or less. After complete removal of the cyclohexane, the resulting capsules were filtered and washed with water. After completion of water washing, the capsules were subjected to vacuum drying, thereby obtaining 18.5 g of encapsulated coupler (I) whose particle diameter was 10 to 30μ and whose coupler content was 50% by weight.

Next, a pre-coating solution was prepared by dispersing, using a homogenizer, a mixture comprising the following composition:

| | |
|---|---|
| Encapsulated coupler (I) | 4 g |
| Silica fine particles (particle diameter: 1 to 5μ) | 3 g |
| 10% aqueous polyvinyl alcohol solution | 10 g |
| Stearic acid amide (particle diameter: 1 to 10μ) | 3 g |
| Water | 100 cc. |

The resulting pre-coating solution was applied onto the surface of the base paper for a diazo copying paper by means of a wire bar and dried to thereby form a pre-coat layer having an adhesion amount of 4 g/m$^2$. Then, a photosensitive solution having the following composition was applied thereon by means of a glass doctor and dried to thereby form a photosensitive layer having an adhesion amount of 1 g/m$^2$:

| | |
|---|---|
| 4-diazo-2,5-dibutoxyphenylmorpholine chloride.½ $ZnCl_2$ | 1.5 g |
| Thiourea | 1 g |
| Isopropyl alcohol | 3 cc |
| Citric acid | 1 g |
| Saponin | 1.1 g |
| Water | 100 cc |

Thus, there was obtained a thermo-developable type diazo copying material (Sample A).

For comparison's sake, on the other hand, a thermo-developable type diazo copying material (Sample B) was prepared by repeating the same procedure as aforesaid except that 4 g of the encapsulated coupler (I) in the pre-coating solution were replaced by 2 g of Naphthol AS fine powder (particle diameter: 1 to 10μ). Further, a thermo-developable type diazo copying material (Sample C) was prepared by repeating the same procedure as above except that the stearic acid amide was removed from the composition of the pre-coating solution.

Next, an original was placed on each sample. It was exposed to ultraviolet rays and then heated at 110° C. for 3 seconds by means of an infrared heater, thereby resulting in the formation of a blue image. Its image density was measured. In order to test the raw preservability, furthermore, each sample was left standing for 24 hours in a desiccator (50° C., 50% RH) to cause forced deterioration. Thereafter, each sample was taken out thereof and was further subjected to overall radiation by means of a fluorescent lamp to decompose the diazo compound in the photosensitive layer completely. The background density was measured with each sample thus treated, and was compared with that of each sample treated according to the same procedure except for the forced deterioration. The image density and background density were evaluated by means of a Macbeth densitometer. The obtained results are as shown in Table-1.

TABLE 1

| | Test items | | |
|---|---|---|---|
| | | Raw preservability (50° C., 50% RH-24 hours) | |
| Sample | Image density (110° C.-3 seconds) | Background density before forced deterioration | Background density after forced deterioration |
| A (Our invention) | 1.24 | 0.11 | 0.16 |
| B (Control) | 1.25 | 0.11 | 0.42 |
| C (Control) | 0.83 | 0.10 | 0.38 |

It can be clearly seen from this table that the article of this invention is superior in image density as well as raw preservability to the control articles.

EXAMPLE 2

5 g of polyethylene wax having a melting point of 85° C. was heat-dissolved in 100 cc of cyclohexane. 5 g of 2-hydroxy-3-naphthoic acid morpholinopropyl amide were dispersed in said solution while heating to a temperature of 50° to 55° C. The resulting solution was stirred vigorously in 200 cc of 10% aqueous gelatine solution heated to a temperature of 50° to 55° C. and thus emulsified. This solution was further distilled under vigorous stirring and reduced pressure to thereby remove the cyclohexane therefrom. After complete removal of the cyclohexane, the resulting capsules were filtered and washed with water. After water washing, the capsules were subjected to vacuum drying, thereby obtaining 9.2 g of encapsulated coupler (II) whose particle diameter was 10 to 30μ and whose coupler content was 50% by weight. Further, according to the same encapsulation method except that the same amount of 3-hydroxycyanoacetanilide was used as the coupler, there were obtained 9.5 g of encapsulated coupler (III) whose particle diameter was 10 to 30μ and whose coupler content was 50% by weight.

Next, a pre-coating solution was prepared by dispersing, using a homogenizer, a mixture comprising the following composition:

| | |
|---|---|
| Encapsulated coupler (II) | 3 g |
| Encapsulated coupler (III) | 2 g |
| Starch fine particles (particle diameter: 5 to 20μ) | 2 g |
| 10% aqueous hydroxyethylcellulose solution | 10 g |
| Behenic acid amide (particle diameter: 1 to 10μ) | 4 g |
| Water | 100 cc |

The resulting pre-coating solution was applied onto the surface of the base paper for a diazo copying paper by means of a wire bar and dried to thereby form a pre-coat layer having an adhesion amount of 5 g/m$^2$. Then, a photosensitive solution having the following composition was applied thereon by means of a glass doctor and dried to thereby form a photosensitive layer having an adhesion amount of 0.8 g/m$^2$:

| | |
|---|---|
| 4-diazo-2,5-diethoxymorpholine chloride.$\frac{1}{2}$ $ZnCl_2$ | 1.8 g |
| Zinc chloride | 2 g |
| Tartaric acid | 1 g |
| Saponin | 0.1 g |
| Water | 100 cc |

Next, an original was placed on the thus obtained thermo-developable-type diazo copying material. The material was exposed to ultraviolet rays and then heated to 100° C. for 5 seconds, thereby forming a high density black image. This copying material exhibited a superior raw preservability as in Example 1.

Further, this diazo copying material was brought into contact with a recorder equipped with a heat pen heated to 110° C. for recording. A high density black image was formed against a yellow background immediately after said contact. Then, the material was subjected overall to light radiation from a fluorescent lamp for 3 seconds with the result that the yellow background was turned white and thus fixed completely.

EXAMPLE 3

5 g of chlorinated paraffin (melting point: 60° to 62° C.) were dissolved in 100 cc of cyclohexane, and thereafter 5 g of Naphthol AS-D were dispersed well in the resulting solution. This solution was stirred vigorously in 200 cc of 10% aqueous polyvinyl alcohol solution and thus emulsified. This emulsified solution was further distilled under vigorous stirring and at a reduced pressure to thereby remove the cyclohexane therefrom. In this case, the heating temperature was maintained at 50° C. or less. After complete removal of the cyclohexane, the resulting capsules were filtered and washed with water. After completion of water washing, the capsules were subjected to vacuum drying, thereby obtaining 8.9 g of encapsulated coupler (IV) whose particle diameter was 10 to 30$\mu$ and whose coupler content was 30% by weight. Next, a pre-coating solution was prepared by dispersing, using a homogenizer, a mixture comprising the following composition:

| | |
|---|---|
| Encapsulated coupler (IV) | 6 g |
| Urea | 2 g |
| Sulfuric acid | 0.2 g |
| Gelatin | 1 g |
| Polystyrene fine powder (particle diameter: 1 to 5$\mu$) | 10 g |
| Oleic acid amide | 5 g |
| 4-diazo-2,5-diethoxyphenyl-N,N—dimethylaniline chloride.$\frac{1}{2}$ $ZnCl_2$ | 1.2 g |
| Saponin | 0.1 g |
| Water | 100 cc |

The resulting solution was applied onto the surface of the base paper for a diazo copying paper to thereby form a photosensitive layer having an adhesion amount of 3 g/m$^2$.

Next, an original was placed on the thus obtained thermo-developable type diazo copying material, and the same was exposed to ultraviolet rays and instantly heated using a xenon flash lamp to form a high density blue image. This copying material exhibited a superior raw preservability as in Example 1.

EXAMPLE 4

20 g of vinyl acetate-butyl methacrylate-styrene copolymer (softening temperature: 98° C.) were dissolved in 100 cc cyclohexane, and thereafter 10 g of Naphthol AS were well dispersed therein. This solution was stirred vigorously in 200 cc of 10% aqueous polyvinyl alcohol solution and emulsified. This emulsified solution was further distilled while being stirred vigorously under a reduced pressure condition to thereby remove the cyclohexane therefrom. After complete removal of the cyclohexane, the resulting capsules were filtered and washed with water. After completion of water washing, the capsules were subjected to vacuum drying, thereby obtaining 19.2 g of encapsulated coupler (V) whose particle diameter was 10 to 30$\mu$ and whose coupler content was 25% by weight.

Alternatively, 15.6 g of encapsulated coupler (V), whose particle diameter was 10 to 30$\mu$ and whose coupler content was 25% by weight, could also be obtained by treating a cyclohexane solution containing 10 g of said copolymer and 10 g of Naphthol AS in accordance with a spray drying method and thus removing the cyclohexane.

Next, a pre-coating solution was prepared by dispersing, using a homogenizer, a mixture comprising the following composition.

| | |
|---|---|
| Encapsulated coupler (V) | 8 g |
| Silica fine particles (particle diameter: 1 to 5$\mu$) | 3 g |
| 10% aqueous polyvinyl alcohol solution | 10 g |
| Behenic acid anilide (particle diameter: 1–10$\mu$) | 3 g |
| Water | 100 cc |

This solution was applied onto the surface of the base paper for a diazo copying paper by means of a wire bar to thereby form a precoat layer having an adhesion amount of 3 g/m$^2$. Then, a photosensitive solution having the following composition was further applied thereon by means of a glass doctor and dried to thereby form a photosensitive layer having an adhesion amount of 1 g/m$^2$:

| | |
|---|---|
| 4-diazo-2,5-dibutoxyphenylmorpholine chloride.$\frac{1}{2}$ $ZnCl_2$ | 1.5 g |
| Thiourea | 1 g |
| Isopropyl alcohol | 3 cc |
| Citric acid | 1 g |
| Saponin | 1.1 g |
| Water | 100 cc |

Thus, a thermal-developable type diazo copying material (Sample D) was prepared. Then, a blue image was formed on Sample D according to the same image forming procedure as Example 1. Thereafter, Sample D was subjected to forced deterioration tests to obtain the results as shown in Table-2. This table contains the data of samples B and C for comparison.

TABLE 2

| Sample | Test items: Image density (110° C.-3 seconds) | Raw preservability (50° C., 50% RH-24 hours): Background density before forced deterio-ration | Background density after forced deterio-ration |
|---|---|---|---|
| D (Our invention) | 1.23 | 0.11 | 0.17 |
| B (Control) | 1.25 | 0.11 | 0.42 |
| C (Control) | 0.83 | 0.10 | 0.38 |

It can be clearly seen from this table that the article of the present invention is superior in image density as well as raw preservability to the control articles.

EXAMPLE 5

15 g of vinyl acetate-lauryl methacrylate copolymer (softening point: 102° C.) were heat-dissolved in 100 cc of naphtha (boiling point: 80°–100° C.). 5 g of 2-hydroxy-3-naphthoic acid morpholinopropylamide were dispersed in this solution while it was heated to a temperature of 50° to 55° C. This solution was stirred vigorously in 200 cc of 10% aqueous gelatin solution, heated to a temperature of 50° to 55° C. and thus emulsified. This emulsified solution was further distilled while stirring vigorously under a reduced pressure condition to thereby remove the naphtha therefrom. After complete removal of the naphtha, the resulting capsules were filtered and washed with water. After completion of water washing, the capsules were subjected to vacuum drying, thereby obtaining 9.2 g of encapsulated coupler (VI) whose particle diameter was 10 to 30μ and whose coupler content was 25% by weight. And, 10.1 g of encapsulated coupler (VII), whose particle diameter was 10 to 30μ and whose coupler content was 25% by weight, were obtained according to the same encapsulation method except that the same amount of 3-hydroxycyanoacetanilide was used as the coupler.

In this connection, it is to be noted that if the naphtha is removed completely at an elevated temperature of 50° to 60° C. in distilling under reduced pressure conditions according to the present examples, there will be obtained a solution comprising dispersed encapsulated coupler in an aqueous gelatine solution. Consequently, the filtering and water washing steps may be omitted, and further said dispersion may be employed as a precoating solution in the subsequent step.

Next, a precoating solution was prepared by dispersing, using a homogenizer, a mixture comprising the following composition:

| | |
|---|---|
| Encapsulated coupler (VI) | 6 g |
| Encapsulated coupler (VII) | 4 g |
| Starch fine particles (particle diameter: 5 to 20μ) | 2 g |
| 10% aqueous hydroxyethylcellulose solution | 10 g |
| N—stearylbenzamide (particle diameter: 1 to 10μ) | 4 g |
| Water | 100 cc |

The resulting pre-coating solution was applied onto the surface of the base paper for a diazo copying paper by means of a wire bar and dried to thereby form a precoat layer having an adhesion amount of 3 g/m$^2$. Then, a photosensitive solution having the following composition was applied thereon by means of a glass doctor and dried to thereby form a photosensitive layer having an adhesion amount of 0.8 g/m$^2$:

| | |
|---|---|
| 4-diazo-2,5-diethoxymorpholine chloride.½ $ZnCl_2$ | 1.8 g |
| Zinc chloride | 2 g |
| Tartaric acid | 1 g |
| Saponin | 0.1 g |
| Water | 100 cc |

Then, the thus obtained thermo-developable type diazo copying material was subjected to the same image-forming and recording procedures as Example 2 with the result that the same results as for Example 2 were also obtained in this case.

EXAMPLE 6

10 g of vinyl acetate-vinyl chloride copolymer (softening point: 83° C.) were dissolved in 100 cc of ligroin, and thereafter 5 g of Naphthol AS-D were dispersed well in the resulting solution. This solution was stirred vigorously in 200 cc of 10% aqueous polyvinyl alcohol solution and thus emulsified. This emulsified solution was further distilled while being stirred vigorously under a reduced condition to thereby remove the ligroin completely. Thus, there were obtained 9.3 g of aqueous encapsulated coupler (VIII) dispersion, said coupler having 10 to 30μ particle diameters and 30% by weight coupler content. Next, a precoating solution was prepared by dispersing, using a homogenizer, a mixture comprising the following composition:

| | |
|---|---|
| Encapsulated coupler (VIII) dispersion (encapsulated coupler content: 10%) | 20 g |
| Urea | 2 g |
| Sulfuric acid | 0.2 g |
| Gelatin | 1 g |
| Polystyrene fine powder (particle diameter: 1–5μ) | 10 g |
| N—oleylacetamide | 5 g |
| 4-diazo-2-butoxy-5-chloro-N,N'—dibenzylaniline chloride.½ $ZnCl_2$ | 1.2 g |
| Saponin | 0.1 g |
| Water | 100 cc |

This precoating solution was applied on the base paper for a diazo copying paper and dried to thereby obtain a photosensitive layer having an adhesion amount of 3 g/m$^2$.

An image was formed on the thus obtained thermo-developable type diazo-copying material according to the same procedure as Example 3. The obtained results were identical with those in Example 3.

EXAMPLE 7

A thermo-developable type diazo copying material (Sample E) was prepared according to the same procedure as Example 1 except that the stearic acid amide in the precoating solution was replaced by behenic acid anilide (particle diameter: 1 to 10μ). Then, a blue image was formed on this sample according to the same image-forming procedure as Example 1 and the sample was subjected to forced deterioration. The results obtained therefrom are as shown in Table-3. The data of Sample B and Sample C were added to Table-3 for purposes of comparison.

TABLE 3

| Sample | Test items: Image density (110° C.-3 seconds) | Raw preservability (50° C., 50% RH-24 hours): Background density before forced deterioration | Raw preservability (50° C., 50% RH-24 hours): Background density after forced deterioration |
|---|---|---|---|
| E (Our invention) | 1.23 | 0.11 | 0.17 |
| B (Control) | 1.25 | 0.11 | 0.42 |
| C (Control) | 0.83 | 0.10 | 0.38 |

It can be clearly seen from this table that the article of the present invention is superior in image density as well as raw preservability to the control articles.

EXAMPLE 8

A thermo-developable type diazo copying material was prepared according to the same procedure as Example 2 except that the behenic acid amide in the precoating solution was replaced by N-stearylbenzamide (particle diameter: 1 to 10$\mu$). The image formation and recording were performed using this copying material according to the same procedure as Example 2. The results obtained therefrom were the same as those of Example 2.

EXAMPLE 9

A thermo-developable type diazo copying material was prepared according to the same procedure as Example 3 except that the oleic acid amide and 4-diazo-2,5-diethoxyphenyl-N,N-dimethylaniline chloride-$\frac{1}{2}ZnCl_2$ in the precoating solution were replaced by N-oleylacetamide and 4-diazo-2-butoxy-5-chloro-N,N-dibenzylaniline chloride.$\frac{1}{2}ZnCl_2$ respectively. The image formation was performed using this copying material according to the same procedure as Example 3. The results obtained therefrom were the same as those of Example 3.

EXAMPLE 10

A thermo-developable type diazo copying material was prepared according to the same procedure as Example 6 except that the Naphthol AS-D and 4-diazo-2-butoxy-5-chloro-N,N-dibenzylaniline chloride.$\frac{1}{2}ZnCl_2$ in the precoating solution were replaced by phloroglucinol and 4-diazo-1-(4'-methoxyphenylmercapto-2,5-diethoxybenzene.$BF_6$ (particle diameter: 1 to 3$\mu$) respectively. The image formation was performed using this copying material according to the same procedure as Example 3 to obtain a black image. This copying material was found to have a raw preservability superior to the same extent as the material of Example 1.

What is claimed is:

1. A thermally developable, diazo-type, copying material comprising a substrate and a photosensitive layer formed on said substrate, said photosensitive layer consisting essentially of a diazonium compound suitable for use in a two component diazotype copying material, an azo coupling component and a color assistant, wherein said color assistant is at least one member selected from the group consisting of fatty acid amides having the formula:

$R^1CONH_2$ wherein $R^1$ is a saturated or unsaturated aliphatic hydrocarbon group having 5 to 24 carbon atoms, N-substituted fatty acid amides having the formula:

$R^1CONHR^2$ wherein $R^1$ is the same as defined above and $R^2$ is an alkyl group having 1 to 5 carbon atoms, phenyl, substituted phenyl, cyclohexyl or substituted cyclohexyl, and N-substituted fatty acid amides having the formula:

$R^1NHCOR^2$ wherein $R^1$ and $R^2$ are the same as defined above respectively;

and wherein said coupling component is in the form of fine particles encapsulated with an encapsulating material to form capsules, said encapsulating material being selected from the group consisting of non-polar wax-like substances having a melting point in the range of 50° to 150° C. and hydrophobic vinyl resins having a softening point in the range of 50° to 150° C.

2. A copying material as claimed in claim 1 wherein the particle diameters of said capsules are in the range of 1 to 50$\mu$.

3. A copying material as claimed in claim 1 wherein said wax-like substance is selected from the group consisting of paraffin wax, polyethylene wax, polypropylene wax and chlorinated paraffin, said vinyl resin is selected from the group consisting of vinyl acetate-methyl methacrylate copolymer, vinyl acetatebutyl methacrylate-styrene copolymer, vinyl acetate-lauryl methacrylate copolymer, butadiene-styrene-methyl methacrylate copolymer, vinyl acetate-styrene-hydroxyethyl methacrylate copolymer, methyl methacrylate-styrene copolymer, polyvinyl chloride, vinylidene chloride-methyl methacrylate copolymer, vinyl acetate-vinyl chloride copolymer, vinyl acetate-styrene copolymer, polystyrene and polyvinylidene chloride.

4. A copying material as claimed in claim 1 wherein the weight ratio of said diazonium compound: said coupler excluding said encapsulating material: said color assistant is in the range of 1:0.1 to 10:0.1 to 20, and the weight ratio of said coupler: said encapsulating material is in the range of 1:0.5 to 10.

5. A copying material as claimed in claim 1 wherein said diazonium compound is selected from the group consisting of compounds having the formula:

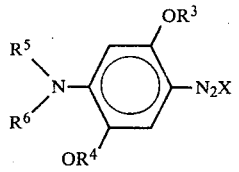

wherein $R^3$ and $R^4$ are each an alkyl group having 1 to 5 carbon atoms, $R^5$ and $R^6$ are each a substituted or non-substituted alkyl, oxyalkyl, aralkyl or cycloalkyl group, or $R^5$ and $R^6$ may form a heterocyclic ring together with the nitrogen atom to which they are bonded, and X represents an anion;

and compounds having the formula:

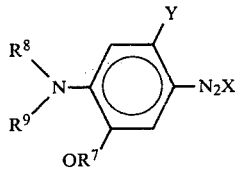

wherein $R^7$ is an alkyl group having 1 to 5 carbon atoms, an alkyl group having oxygen atoms or a carbonyl group in the main chain thereof, or a substituted or unsubstituted phenyl group, $R^8$ and $R^9$ are each a substituted or unsubstituted alkyl group, an alkyl group having oxygen atoms or a carbonyl group in the main chain thereof, a oxyalkyl group, an aralkyl group or a cycloalkyl group, or $R^8$ and $R^9$ may form a heterocyclic ring together with the nitrogen atom to which they are bonded, Y is a halogen and X is an anion.

6. A copying material as claimed in claim 1 wherein said photosensitive layer is formed on said substrate in an amount in the range of 2.5 to 15 g/m$^2$.

7. A copying material as claimed in claim 1 wherein said photosensitive layer comprises a first sublayer consisting essentially of said encapsulated coupler and said color assistant, said first sublayer being formed directly on said substrate in an amount of 2 to 10 g/m$^2$, and a second sublayer consisting essentially of said diazonium compound, said second sublayer being formed directly on said first sublayer in an amount of 0.5 to 5 g/m$^2$.

* * * * *